US005714235A

United States Patent [19]

Takeuchi et al.

[11] Patent Number: 5,714,235

[45] Date of Patent: Feb. 3, 1998

[54] INK-JET RECORDING METHOD

[76] Inventors: Tatsuo Takeuchi; Sono Gu, both of c/o Canon Kabushiki Kaisha 30-2, 3-chome, Shimomaruko, Ohta-ku; Yoshihiro Kuroyama; Teruhisa Shimada, both of c/o Nippon Paper Industries Co., Ltd. 1-30-6, Kamiochiai, Shinjuku-ku, all of Tokyo, Japan

[21] Appl. No.: 699,526

[22] Filed: Aug. 19, 1996

Related U.S. Application Data

[62] Division of Ser. No. 274,024, Jul. 12, 1994, Pat. No. 5,567,513.

[30] Foreign Application Priority Data

Jul. 13, 1993 [JP] Japan ..... 5-195270
Jul. 13, 1993 [JP] Japan ..... 5-195271

[51] Int. Cl.[6] ..... B41M 5/00; B41J 2/01; B05D 5/04

[52] U.S. Cl. ..... 428/195; 347/40; 347/54; 347/56; 347/105; 347/106; 428/206; 428/211; 428/331; 428/342; 428/409; 428/478.2; 428/521; 428/537.5

[58] Field of Search ..... 428/331, 195, 428/206, 211, 342, 409, 478.2, 521, 537.5; 347/40, 54, 56, 105, 106

[56] References Cited

U.S. PATENT DOCUMENTS 4,490,434 12/1984 Oshima et al. ..... 428/341
4,770,934 9/1988 Yamasaki et al. ..... 428/331
4,892,591 1/1990 Ogawa et al. ..... 106/482
5,372,884 12/1994 Abe et al. ..... 428/331

FOREIGN PATENT DOCUMENTS

0513975A1 11/1992 European Pat. Off. .
62-95285 5/1987 Japan .

*Primary Examiner*—Pamela R. Schwartz

[57] ABSTRACT

An ink-jet recording paper sheet for ink-jet recording with on-demand type heads having a multi-nozzle comprises a recording layer formed on one face of a base paper sheet to give a basis weight of the recording paper of from 150 to 250 g/m$^2$ with a coating color which contains a pigment and a binder, the pigment containing synthetic silica having a BET specific surface area ranging from 250 to 500 m$^2$/g at a content of not less than 80% by weight of the pigment, the binder containing casein and styrene-butadiene rubber, the weight ratio of the pigment to the binder ranging from 1.8 to 2.4, the recording layer having coating solid in an amount ranging from 15 to 25 g/m$^2$, and surface roughness by ten-point-height of the recording layer ranging from 0.5 to 5 μm, and the paper sheet being curled at a maximum curling height ranging from 0 to 20 mm in A4 paper size with the printed face upside. An ink-jet recording method ejects ink droplets by thermo energy from an on-demand type head having a plurality of nozzles onto the recording paper sheet.

2 Claims, No Drawings

INK-JET RECORDING METHOD

This application is a division of application Ser. No. 08/274,024, filed Jul. 12, 1994 now U.S. Pat. No. 5,567,513.

BACKGROUND OF THE INVENTION

1. Field of the Invention

The present invention relates to recording paper for ink-jet recording (hereinafter referred to as ink-jet recording paper) of coated-paper type which is useful for recording with an ink-jet recording apparatus, particularly for recording with an ink-jet recording apparatus equipped with a recording head having a plurality of ink-ejection nozzles.

The present invention also relates to an ink-jet recording method employing the above ink-jet recording paper.

2. Related Background Art

The ink-jet recording system, which ejects an ink (recording liquid) directly onto a recording paper sheet, is attracting attention because of its low operation cost and low noise generation.

In recent years, in ink-jet recording, multi-nozzle type recording apparatuses have come to be used for full-color image recording by use of a plurality of color inks at a high recording speed.

For such a recording system, aqueous inks are used in view of safety and printing characteristics of the ink. The recording paper therefor is required to absorb the ink quickly; not to cause running of ink even when different colors of ink dots are overlapped; to allow appropriate ink-dot spreading; to enable formation of ink dots in a shape approximate to a true circle with a sharp dot edge; and naturally to have sufficient whiteness of the recording face in order to obtain high density and high contrast of the dots.

Hitherto, coated paper is used to satisfy the above requirements. However, the coated paper sheet sometimes cockles or wrinkles depending on the environmental conditions.

Japanese Patent Application Laid-Open No. 62-95285 discloses improved cast-coated paper to satisfy the above requirements for the image formation and to prevent the wrinkle formation.

Such recording paper, however, involves various problems when it is used for ink-jet recording with an on-demand type ink-jet apparatus having a multi-nozzle which applies a large amount of ink locally in a short time. If ink absorbency of the recording face is made lower to achieve higher optical density of the recorded image, the applied ink is liable to bleed and preferential absorption of the dyes in the inks is liable to occur to cause color irregularity: for example, black color printing with four color-inks of yellow, cyan, magenta, and black may result in irregular brown colored pattern on a black background (a bronze phenomenon).

If the recording layer is modified to absorb the ink at the surface portion, the ink causes swelling of the surface portion of the recording layer, whereby fine roughness may be caused on the cast-coated surface to lower the gloss at the printed area.

If composition of a coating color for recording layer formation is changed to raise the ink absorbency of the recording layer, another problem of drop of optical density of the print arises, although the above surface roughness formation is prevented.

The cast-coated paper sheet can be made resistant to cockling and wrinkling by increasing the thickness of the paper sheet to utilize the inherent rigidity of the paper.

However, in the on-demand type ink-jet recording system employing a multi-nozzle with the increased thickness of the recording paper, the ink absorption is completed at the portion of printed side without penetration of the ink into the interior of the recording paper sheet, and if the printing is practiced on the entire surface of the recording paper, the printed face side of the paper shrinks as a whole to cause significant curling with the printed face concaved.

SUMMARY OF THE INVENTION

The present invention intends to provide recording paper for ink-jet recording which is free from the technical problems involved in the prior art, and is capable of forming high-density full color images by use of a plurality of ink-jet heads having a multi-nozzle with satisfactory ink absorbency without causing ink running, and also intends to provide an ink-jet recording method using the above recording paper.

The present invention further intends to provide a cast-coated paper type of recording paper for ink-jet recording which has solved the problems of the above prior art, having satisfactory printing suitability with extremely low curling tendency, and being useful for an on-demand type ink-jet recording system employing a multi-nozzle, and also intends to provide an ink-jet recording method using the above recording paper.

The recording paper sheet of the present invention for ink-jet recording with on-demand type heads having a multi-nozzle comprises a recording layer formed on one face of a base paper sheet with a coating color which contains a pigment and a binder, the pigment containing synthetic silica having a BET specific surface area ranging from 250 to 500 $m^2/g$ at a content of not less than 80% by weight of the pigment, the binder containing casein and styrene-butadiene rubber, the weight ratio of the pigment to the binder ranging from 1.8 to 2.4, the recording layer having coating solid in an amount ranging from 15 to 25 $g/m^2$, and surface roughness by ten-point-height of the recording layer ranging from 0.5 to 5 μm.

In another embodiment, the recording paper sheet of the present invention for ink-jet recording with on-demand type heads having a multi-nozzle comprises a recording layer formed on one face of a base paper sheet to give a basis weight of the recording paper of from 150 to 250 $g/m^2$ with a coating color which contains a pigment and a binder, the pigment containing synthetic silica having a BET specific surface area ranging from 250 to 500 $m^2/g$ at a content of not less than 80% by weight of the pigment, the binder containing casein and styrene-butadiene rubber, the recording layer having coating solid in an amount of from 15 to 25 $g/m^2$, and the paper sheet being curled at a maximum curling height at A4 paper size of not more than 20 mm with the recording face upside.

The ink-jet recording method of the present invention ejecting ink droplets by thermo energy from an on-demand type head having a plurality of nozzles onto a recording paper sheet, the recording paper sheet, comprising a recording layer formed on one face of a base paper sheet with a coating color which contains a pigment and a binder, the pigment containing synthetic silica having a BET specific surface area ranging from 250 to 500 $m^2/g$ at a content of not less than 80% by weight of the pigment, the binder containing casein and styrene-butadiene rubber, the weight ratio of the pigment to the binder ranging from 1.8 to 2.4, the recording layer having coating solid in an amount ranging from 15 to 25 $g/m^2$ and surface roughness by ten-point-height of the recording layer ranging from 0.5 to 5μm.

In another embodiment, the ink-jet recording method of the present invention ejecting ink droplets by thermo energy from an on-demand type head having a plurality of nozzles onto a recording paper sheet, the recording paper sheet, comprising a recording layer formed on one face of a base paper sheet to give a basis weight of the recording paper of from 150 to 250 g/m$^2$ with a coating color which contains a pigment and a binder, the pigment containing synthetic silica having a BET specific surface area ranging from 250 to 500 m$^2$/g at a content of not less than 80% by weight of the pigment, the binder containing casein and styrene-butadiene rubber, the recording layer having coating solid in an amount of from 15 to 25 g/m$^2$, and the paper sheet being curled at a maximum curling height ranging from 0 to 20 mm in A4 paper size with the printed face upside.

DETAILED DESCRIPTION OF THE PREFERRED EMBODIMENTS

According to a first embodiment of the present invention, there is provided an ink-jet recording paper sheet of cast-coated paper type which has high ink-absorbency without causing running of ink or feathering of ink dots, and enables formation of images with high quality and high optical density. The ink-jet recording paper sheet enables formation of full-color images of high density and high quality also in recording with an on-demand type of ink-jet recording apparatus having a multi-nozzle.

According to a second embodiment of the present invention, there is provided an ink-jet recording paper sheet of cast-coated paper type which has satisfactory printing characteristics and is curled extremely less by printing, and is suitable for ink-jet recording with an on-demand type ink-jet recording system employing a multi-nozzle.

The preferred embodiments are described below in detail.

[First Embodiment]

The ink-jet recording paper of the first embodiment has a coat layer (recording layer) comprising casein and styrene-butadiene rubber which are aqueous binder and, at least, synthetic silica. The styrene-butadiene rubber, which is formed from styrene and butadiene as the main constituents, may contain a third constituent. The synthetic silica employed as the pigment includes silicic acids called generally non-crystalline silica, amorphous silica, silicic acid anhydride, silicic acid hydrate, fine powdery silica, white carbon, and so forth. The silica for use in the present invention is required to have a SET specific surface area of 250 to 500 m$^2$/g.

Additional pigment which may be used in combination with the silica includes kaolin, talc, calcium carbonate, barium sulfate, aluminum hydroxide, titanium dioxide, zinc oxide, satin white, diatomaceous earth, acid clay, zeolite, colloidal silica, organic pigments, etc. The pigment in the coat layer contains the synthetic silica preferably at a content of not lower than 80% by weight. At the synthetic silica content of lower than 80% by weight, the ink is absorbed locally at the surface of the coat layer, which makes the deposited dot shape far apart from a true circle, and moreover, the ink absorbency of the paper is low, causing remarkable bronze phenomenon. Furthermore, if the weight ratio of the pigment to the binder is higher than 2.4, the printed image density is significantly low, whereas if this ratio is lower than 1.8, gloss of the printed images is significantly low.

At the BET specific surface area of the synthetic silica of lower than 250 m$^2$/g the ink absorbency of the recording paper is extremely low to cause ink running, even if the synthetic silica is contained in the above pigment/binder ratio range in the coat layer. On the other hand, at the BET specific surface area of higher than 500 m$^2$/g, the ink absorbency is excessively high over the coat layer to cause diffusion of the ink throughout the coat layer and to lower the image density disadvantageously.

For the coating operation in the present invention, any coating machine is useful which has a blade coater, an air-knife coater, a roll coater, a curtain coater, a bar coater, a gravure coater, a comma coater, or the like. A coating machine is useful which is equipped, following the coating step, with a device for cast-coating by a coagulation method which coagulates casein in the coat layer, immediately after the coating and while the coated layer is still in a wet state, by treating the coated layer with an aqueous solution of salts such as nitrate, sulfate, formate, acetate, etc. of metals such as zinc, calcium, barium, magnesium, aluminum, etc. After the coagulation, the coat layer may be dried by pressing to a heated mirror finished surface for dry finishing.

The ink-jet recording paper sheet has a surface roughness by ten-point-height of from 0.5 to 5.0 μm, thereby giving high gloss. With the roughness by ten-point-height of higher than 5.0 μm, the gloss of the ink-jet recording paper is lower, whereas at the roughness of less than 0.5 μm, the ratio of pigment/binder is relatively lower at the outermost surface layer to cause decrease of ink absorbency. The surface roughness by ten-point-height is more preferably in the range of from 0.5 to 3.0 μm.

The coating weight is preferably in the range of from 15 to 25 g/m$^2$. At the coating weight of less than 15 g/m$^2$, ink tends to cause running, whereas at the amount of more than 25 g/m$^2$, the density of the printed image is lower.

In the present invention, the coating color may further contain, if necessary, a pigment-dispersing agent, a water-retaining agent, a viscosity-increasing agent, an antifoaming agent, a releasing agent, a coloring agent, a water-proofing agent, a wetting agent, a fluorescent dye, a UV-absorbing agent, or the like.

[Second Embodiment]

The ink-jet recording paper of the second embodiment has, similarly to the above-described first embodiment, a coat layer (recording layer) comprising casein and styrene-butadiene rubber which are aqueous binder and a pigment containing, at least, synthetic silica formed on a base paper sheet.

The combinedly usable pigment, the method for application of the coating color, and the coating amount are the same as in the first embodiment.

The base paper sheet to be covered with the aforementioned coating layer is not particularly limited, provided that the resulting ink-jet recording paper after the coating has a basis weight ranging from 150 to 250 g/m$^2$. If the resulting ink-jet recording paper has a basis weight of less than 150 g/m$^2$, the recording paper tends to become cockled or wrinkled after recording, and prevention of the curling of the recording paper sheet is difficult except for the case of single color recording. On the other hand, if the paper has a basis weight of more than 250 G/m$^2$, the paper sheet has much lower deliverability and the operability of the recording apparatus is low when such a paper sheet is used in ink-jet recording. The characteristics of the base paper are not limited provided that the base paper is wood-free paper produced by conventionally known technique.

The curling of the base paper by printing can be mitigated by various ways, including moistening with steam at the non-coated face side of the base paper after or during application of the coating color; application of sufficient water by conducting the coating with bar coater or the like and subsequent drying; treatment with a de-curler to give plastic deformation to the resulting coated paper so as to give slight curling with the printing face convexed; and minimization of shrinkage of the recording paper to decrease shrinkage of the printed face caused by water in the applied aqueous ink and subsequent drying, so as to decrease the curling.

However, if the ink-jet recording paper sheet is made to curl excessively prior to printing with the recording layer side convexed, the curl obdurately remains in undesired direction when the amount of ink application is small, whereby the quality of the ink-jet recording paper is impaired, and frequency of paper jamming is increased. On the other hand, if the ink-jet recording paper is made to curl with the recording layer side concaved prior to printing, the curling is further increased without intended correction of the curling. With an A4-sized recording paper sheet, the maximum amount of curling imparted to the recording paper prior to printing is preferably in the range of from 0 to 20 mm with the printing face convexed.

The present invention is described below in more detail by reference to Examples and Comparative Examples.

Examples 1 to 3 and Comparative Examples 1 to 7 are concerned with the first embodiment.

Example 1 (Ink-Jet Recording Paper 1):

An aqueous coating color having a solid matter content of 30% by weight was prepared by homogeneously mixing 85 parts by weight of synthetic silica (BET specific surface area: 300 $m^2/g$, trade name "Mizukasil P-707", manufactured by Mizusawa Industrial Chemical Ltd.) and 15 parts by weight of light calcium carbonate (trade name "Tamapearl 121", manufactured by Okutama Kogyo Co., Ltd.) as the pigment; 25 parts by weight of casein (lactic casein made in New Zealand) and 25 parts by weight of styrene-butadiene rubber (trade name "SN307" manufactured by Sumitomo Dow Ltd.) as the binder; (pigment/binder ratio=2.0); and 2 parts by weight of calcium stearate (trade name "Nopcoat C104" manufactured by San Nopco Co., Ltd.) as the releasing agent.

The resulting coating color was applied onto a raw paper sheet of basis weight of 191 $g/m^2$ by means of a roll coater. Then the coated layer was coagulated with aqueous 2% by weight solution of zinc formate. While the coated layer was still in a wet state, the coated paper sheet was dried by pressing onto a mirror-finished drum kept at 100° C. to obtain an ink-jet recording paper sheet of the present invention having a coat layer at a coating weight of 23 $g/m^2$.

This ink-jet recording paper sheet had a surface roughness by ten-point-height of 1.48 μm, and a white paper gloss of 72% according to a 60-degree method.

Example 2 (Ink-Jet Recording Paper 2):

An aqueous coating color having a solid matter content of 30% by weight was prepared by homogeneously mixing 100 parts by weight of synthetic silica (BET specific surface area: 390 $m^2/g$ trade name "Mizukasil P-78F", manufactured by Mizusawa Industrial Chemical Ltd.) as the pigment; 30 parts by weight of casein (lactic casein made in New Zealand) and 25 parts by weight of styrene-butadiene rubber (trade name "JSR-0801", manufactured by Japan Synthetic Rubber Co., Ltd.) as the binder; (pigment/binder ratio=1.82); and 2 parts by weight of calcium stearate (trade name "Nopcoat C104", manufactured by San Nopco Co., Ltd.) as the releasing agent.

The resulting coating color was applied onto a raw paper sheet of basis weight of 191 $g/m^2$ by means of a roll coater. Then the coated layer was coagulated with aqueous 5% (by weight) solution of zinc formate. While the coated layer was in a wet state, the coated paper sheet was dried by pressing onto a mirror-finished drum kept at 100° C. to obtain an ink-jet recording paper sheet of the present invention having a coat layer at a coating weight of 18 $g/m^2$.

This ink-jet recording paper sheet had a surface roughness by ten-point-height of 1.37 μm, and a white paper gloss of 69% according to a 60-degree method.

Example 3 (Ink-Jet Recording Paper 3):

An aqueous coating color having a solid matter content of 30% by weight was prepared by homogeneously mixing 100 parts by weight of synthetic silica (BET specific surface area: 270 $m^2/g$, trade name "Finesil X-37", manufactured by Tokuyama Corp.) as the pigment; 25 parts by weight of casein (lactic casein made in New Zealand) and 20 parts by weight of styrene-butadiene rubber (trade name "JSR-0801", manufactured by Japan Synthetic Rubber Co., Ltd.) as the binder (pigment/binder ratio=2.22); and 2 parts by weight of calcium stearate (trade name "Nopcoat C104", manufactured by San Nopco Co., Ltd.) as the releasing agent.

The resulting coating color was applied onto a raw paper sheet of basis weight of 191 $g/m^2$ by means of a roll coater. Then the coated layer was coagulated with aqueous 2% (by weight) solution of zinc formate. While the coated layer was in a wet state, the coated paper sheet was dried by pressing onto a mirror-finished drum kept at 100° C. to obtain an ink-jet recording paper sheet of the present invention having coat layer at a coating weight of 20 $g/m^2$.

This ink-jet recording paper sheet had a surface roughness by ten-point-height of 1.50 μm, and a white paper gloss of 63% according to a 60-degree method.

Comparative Example 1 (Coated Paper A):

A coated paper sheet of Comparative Example was prepared in the same manner as in Example 1 except that 100 parts by weight of Mizukasil P-707 as the pigment, and 30 parts by weight of lactic casein and 30 parts by weight of SN307 as the binder were used (pigment/binder ratio=1.67).

This coated paper sheet had a surface roughness by ten-point-height of 1.23 μm, and a white paper gloss of 78% according to a 60-degree method.

Comparative Example 2 (Coated Paper B):

A coated paper sheet of Comparative Example was prepared in the same manner as in Example 1 except that 100 parts by weight of Mizukasil P-707 as the pigment, and 20 parts by weight of lactic casein and 20 parts by weight of SN307 as the binder were used (pigment/binder ratio=2.50).

This coated paper sheet had a surface roughness by ten-point-height of 1.52 μm, and a white paper gloss of 65% according to a 60-degree method.

Comparative Example 3 (Coated Paper C):

A coated paper sheet of Comparative Example was prepared in the same manner as in Example 3 except that synthetic silica (BET specific surface area: 240 $m^2/g$, trade name "Finesil X-70", manufactured by Tokuyama Corp.) was used as the pigment.

This coated paper sheet had a surface roughness by ten-point-height of 1.45 μm, and a white paper gloss of 72% according to a 60-degree method.

Comparative Example 4 (Coated Paper D):

A coated paper sheet of Comparative Example was prepared in the same manner as in Example 2 except that the amount of the coating weight was 13 $g/m^2$.

This coated paper sheet had a surface roughness by ten-point-height of 1.39 μm, and a white paper gloss of 63% according to a 60-degree method.

Comparative Example 5 (Coated Paper E):

A coated paper sheet of Comparative Example was prepared in the same manner as in Example 2 except that the amount of the coating weight was 28 $g/m^2$.

This coated paper sheet had a surface roughness by ten-point-height of 1.32 μm, and a white paper gloss of 75% according to a 60-degree method.

Comparative Example 6 (Coated Paper F):

A coated paper sheet of Comparative Example was prepared in the same manner as in Example 1 except that 70 parts by weight of synthetic silica and 30 parts of preciptated calcium carbonate were used as the pigment.

This coated paper sheet had a surface roughness by ten-point-height of 1.30 μm, and a white paper gloss of 88% according to a 60-degree method.

Comparative Example 7 (Coated Paper G):

Commercial cast-coated paper (basis weight: 209.3 g/m$^2$, trade name "Espricoat FP", manufactured by Nippon Paper Industries Co., Ltd.).

Printing Test:

Printing was conducted on the above ink-jet recording paper sheets of Examples and Comparative Examples respectively with inks of yellow, magenta, cyan, and black by employing an on-demand type ink-jet recording apparatus which conducts recording by ink droplets formed by thermal energy in the recording head. The printing test results are shown in Table 1.

The evaluation was made as below.

(1) Feathering and Running:

Printing was conducted by use of the above four color-inks respectively in the same amount such that the printing was 250% relative to the one-color full printing taken as 100%. The printing was conducted in solid in a rectangular shape. When no running-out of the ink from the rectangular was observed, the results were evaluated as good, and marked with the symbol "o", and otherwise evaluated as poor, and marked with the symbol "x".

(2) Optical Density:

Each of the colors was printed in solid, and the optical density thereof was measured with a Macbeth Densitometer (RD-914, SPI filter). The values obtained with the yellow color ink are shown in the Table.

(3) Gloss after Printing:

Printing was conducted by use of the above four color-inks respectively in the same amount such that the printing was 250% relative to the one-color full printing taken as 100%. The printed paper sheets, after left standing in an atmosphere of 23° C. and 60% RH for 30 minutes, were tested for gloss according to the 60-degree method.

(4) Bronze Phenomenon:

Printing was conducted by use of the above four color-inks respectively in the same amount such that the printing was 250% relative to the one-color full printing taken as 100%. The printed paper sheets, after left standing in an atmosphere of 23° C. and 60% RH for 30 minutes, were observed to see whether discoloration to brown occurred. If 50% or more of the solid-printed area changed to brown, the result was evaluated to be poor, and denoted by the symbol "x", and if 25% or less thereof turned brown, the result was evaluated to be good, and marked with the symbol "o".

TABLE 1

| Ink-jet recording paper (Coated paper) | Feathering or Running | Optical density | Gloss after printing | Bronze phenomenon |
|---|---|---|---|---|
| 1 | o | 1.20 | 45 | o |
| 2 | o | 1.30 | 50 | o |
| 3 | o | 1.25 | 40 | o |
| A | o | 1.20 | 23 | x |
| B | o | 1.05 | 40 | o |

TABLE 1-continued

| Ink-jet recording paper (Coated paper) | Feathering or Running | Optical density | Gloss after printing | Bronze phenomenon |
|---|---|---|---|---|
| C | x | 1.27 | 25 | x |
| D | x | 1.33 | 20 | x |
| E | o | 1.07 | 50 | o |
| F | x | 0.95 | 31 | x |
| G | Not suitable for ink-jet printing | | | o |

At the optical density of lower than 1.20, the dynamic range is extremely narrow to lower the image quality. With decrease of the gloss after the printing below 30%, the gloss decreases remarkably, which makes the paper unsuitable for practical use.

As described above, in the first embodiment, the present invention provides an ink-jet recording paper sheet which is a cast-coated paper sheet based on an ordinary paper and is suitable for on-demand type ink-jet recording employing a multi-nozzle, not causing running or feathering of ink, giving an image of high optical density, causing little lowering of the gloss after printing, and giving a high-quality image without bronze phenomenon.

Examples 4 to 6, Comparative Examples 8 to 14, and Reference Examples 1 to 3 are concerned with the second embodiment of the present invention.

Reference Example 1 (Ink-Jet Recording Paper 4):

An aqueous coating color having a solid matter content of 30% by weight was prepared by homogeneously mixing 85 parts by weight of synthetic silica (BET specific surface area: 300 m$^2$/g, trade name "Mizukasil P-707", manufactured by Mizusawa Industrial Chemical Ltd.) and 15 parts by weight of precipitated calcium carbonate (trade name "Tamapearl 121", manufactured by Okutama Kogyo Co., Ltd.) as the pigment; 25 parts by weight of casein (lactic casein made in New Zealand) and 25 parts by weight of styrene-butadiene rubber (trade name "SN307" manufactured by Sumitomo Dow Ltd.) as the binder; and 2 parts by weight of calcium stearate (trade name "Nopcoat C104" manufactured by San Nopco Co., Ltd.) as the releasing agent.

The resulting coating liquid was applied onto a raw paper sheet of basis weight of 191 g/m$^2$ by means of a roll coater. Then the coated layer was coagulated with aqueous 2% by weight solution of zinc formate. While the coated layer was in a wet state, the coated paper was dried by pressing onto a mirror-finished drum kept at 100° C. to obtain an ink-jet recording paper sheet of the present invention having a coating layer at a coating weight of 23 g/m$^2$.

This recording paper sheet which was cut in an A4 size showed a maximum convex curl height of 35 mm with the non-printing face upside.

Reference Example 2 (Ink-Jet Recording Paper 5):

An aqueous coating color having a solid matter content of 30% by weight was prepared by homogeneously mixing 65 parts by weight of synthetic silica (BET specific surface area: 390 m$^2$/g, trade name "Mizukasil P-78F", manufactured by Mizusawa Industrial Chemical Ltd.) and 35 parts by weight of kaolin (trade name "Ultrawhite 90", manufactured by Engelhard M & C Co.) as the pigment; 25 parts by weight of casein (lactic casein made in New Zealand) and 25 parts by weight of styrene-butadiene rubber (trade name "JSR-0801", manufactured by Japan Synthetic Rubber Co., Ltd.) as the binder; and 2 parts by weight of calcium stearate (trade name "Nopcoat C104", manufactured by San Nopco Co., Ltd.) as the releasing agent.

The resulting coating color was applied onto a raw paper sheet of basis weight of 139 g/m$^2$ by means of a roll coater. Then the coated layer was coagulated with aqueous 5% (by weight) solution of zinc formate. While the coated layer was in a wet state, the coated paper was dried by pressing onto a mirror-finished drum kept at 100° C. to obtain an ink-jet recording paper sheet of the present invention having a coating layer at a coating weight of 18 g/m$^2$.

This recording paper sheet which was cut in an A4 size showed a maximum convex curl height of 25 mm with the non-printing face upside.

Reference Example 3 (Ink-Jet Recording Paper 6):

An aqueous coating color having a solid matter content of 30% by weight was prepared by homogeneously mixing 100 parts by weight of synthetic silica (BET specific surface area: 270 m$^2$/g, trade name "Finesil X-37", manufactured by Tokuyama Corp.) as the pigment; 30 parts by weight of casein (lactic casein made in New Zealand) and 20 parts by weight of styrene-butadiene rubber (trade name "JSR-0801", manufactured by Japan Synthetic Rubber Co., Ltd.) as the binder; and 2 parts by weight of calcium stearate (trade name "Nopcoat C104", manufactured by San Nopco Co., Ltd.) as the releasing agent.

The resulting coating color was applied onto a raw paper sheet of basis weight of 191 g/m$^2$ by means of a roll coater. Then the coated layer was coagulated with aqueous 2% (by weight) solution of zinc formate. While the coated layer was in a wet state, the coated paper was dried by pressing onto a mirror-finished drum kept at 100° C. to obtain an ink-jet recording paper 6 of the present invention having a coating weight of 20 g/m$^2$.

This recording paper which was cut in an A4 size showed a maximum convex curl height of 28 mm with the non-printing face upside.

Example 4 (Curl Treatment)

The above ink-jet recording paper sheet 4 was moistened with steam from the non-coated face side. After drying, the paper sheet was wound up with the coated face outside. The paper sheet was unwound and cut in A4 paper size. This paper sheet showed a maximum convex curl height of 14 mm with the recording face upside. This paper sheet is referred to as "Ink-jet Recording Paper (i)".

Example 5 (Curl Treatment)

The above ink-jet recording paper sheet 5 was moistened by application of water on the non-coated face with a bar coater. After drying by infrared heater, the paper sheet was wound up in a roll. The paper sheet was cut in A4 paper size. This paper sheet showed a maximum convex curl height of 3 mm with the recording face upside. This paper sheet is referred to as "Ink-jet Recording Paper (ii)".

Example 6 (Curl Treatment)

The ink-jet recording paper 6 was treated with a de-curler. After the treatment, the paper sheet was cut in A4 paper size. This paper sheet showed a maximum convex curl height of 20 mm with the recording face upside. This paper sheet is referred to as "Ink-jet Recording Paper (iii)"

Comparative Example 8 (Coated Paper H):

A coated paper sheet was prepared in the same manner as in Reference Example 1 except that a coat base paper sheet having a basis weight of 110 g/m$^2$ was used as the raw paper sheet, and the curl treatment was conducted in the same manner as in Example 4. The recording paper sheet which was cut in A4 paper size showed a maximum convex curl height of 9 mm with the recording face upside.

Comparative Example 9 (Coated Paper I):

A coated paper sheet was prepared in the same manner as in Reference Example 1 except that a coat base paper sheet having a basis weight of 260 g/m$^2$ was used as the raw paper sheet, and the curl treatment was conducted in the same manner as in Example 5. The recording paper sheet which was cut in A4 paper size showed a maximum convex curl height of 6 mm with the recording face upside.

Comparative Example 10 (Coated Paper J):

A coated paper sheet was prepared in the same manner as in Reference Example 3 except that synthetic silica having a BET specific surface area of 240 m$^2$/g (trade name "Finesil X70", manufactured by Tokuyama Corp.) was used as the pigment, and the curl treatment was conducted in the same manner as in Example 6. The recording paper sheet which was cut in A4 size showed a maximum convex curl height of 25 mm with the recording face upside.

Comparative Example 11 (Coated Paper K):

A coated paper sheet was prepared in the same manner as in Reference Example 2 except that the coating weight was changed to 13 g/m$^2$. The coated paper sheet was subjected to curl treatment in the same manner as in Example 5. The recording paper sheet which was cut in A4 paper size showed a maximum convex curl height of 21 mm with the recording face upside.

Comparative Example 12 (Coated Paper L):

A coated paper sheet was prepared in the same manner as in Reference Example 2 except that the coating weight was changed to 33 g/m$^2$. The coated paper sheet was subjected to curl treatment in the same manner as in Example 5. The recording paper sheet which was cut in A4 size showed a maximum convex curl height of 39 mm with the recording face upside.

Comparative Example 13 (Coated Paper M):

A coated paper sheet was prepared in the same manner as in Reference Example 1 except that the amount of the silica was 55 parts by weight and the amount of precipitated calcium carbonate was 45 parts by weight. The coated paper sheet was subjected to curl treatment in the same manner as in Example 4. The recording paper sheet which was cut in A4 paper size showed a maximum convex curl height of 33 mm with the recording face upside.

Comparative Example 14 (Coated Paper N):

Commercial cast-coated paper (trade name "Espricoat FP", manufactured by Nippon Paper Industries Co., Ltd. basis weight: 209.3 g/m$^2$). The recording paper sheet which was cut in A4 size showed a maximum convex curl height of 0 mm with the recording face upside.

Printing Test

Printing test was conducted in the same manner as in Example 1. The results of the printing test are shown in Table 2.

The properties below were evaluated.

(1) Ink leathering and running:

The evaluation was conducted in the same manner as in Example 1.

(2) Optical density:

The optical density was evaluated in the same manner as in Example 1.

(3) Degree of curling:

Printing was conducted by use of the above four color-inks respectively in the same amount such that the printing was 200% relative to the one-color full printing taken as 100%. The printed paper sheets, after left standing in an atmosphere of 23° C. and 60% RH for 15 minutes. The maximum height of curling was measured for an A4-sized paper sheet on a surface plate with the printed face downside in centimeter unit.

TABLE 2

| Ink-jet recording paper (Coated paper) | Running or feathering | Optical density | Degree of curling | Deliverability |
|---|---|---|---|---|
| 4 | o | 1.20 | 5.5 | Good |
| 5 | o | 1.30 | 7.0 | Good |
| 6 | o | 1.25 | 6.0 | Good |
| (i) | o | 1.20 | 1.8 | Good |
| (ii) | o | 1.30 | 0.8 | Good |
| (iii) | o | 1.25 | 2.5 | Good |
| H | o | 1.20 | Cylindrical | Good |
| I | o | 1.20 | 5.0 | Jamming |
| J | x | 1.27 | 5.5 | Good |
| K | x | 1.33 | 6.3 | Good |
| L | o | 1.07 | 7.8 | Good |
| M | x | 0.95 | 5.5 | Good |
| N | Not suitable for ink-jet printing | | | Good |

As shown by the results of the printing test, the present invention provides a cast-coated paper type of ink-jet recording paper which has satisfactory printing suitability with extremely low curling tendency, and is useful for the on-demand type ink-jet recording system employing multi-nozzles.

What is claimed is:

1. An ink-jet recording method comprising ejecting ink droplets by thermal energy from an on-demand head having a plurality of nozzles onto a recording paper sheet, the recording paper sheet comprising a recording layer formed on one face of a base paper sheet, said recording layer comprising a pigment and a binder, the pigment containing synthetic silica having a BET specific surface area ranging from 250 to 500 $m^2/g$ at a content of not less than 80% by weight of the pigment, the binder containing casein and styrene-butadiene rubber, the weight ratio of the pigment to the binder ranging from 1.8 to 2.4, the recording layer having coating solids in an amount ranging from 15 to 25 $g/m^2$, and surface roughness by ten-point-height of the recording layer ranging from 0.5 to 5 μm.

2. An ink-jet recording method according to claim 1, wherein surface roughness by the ten-point-height of the recording layer ranges from 0.5 to 3.0 μm.

* * * * *

UNITED STATES PATENT AND TRADEMARK OFFICE

CERTIFICATE OF CORRECTION

PATENT NO. : 5,714,235

DATED : February 3, 1998

INVENTOR(S) : TATSUO TAKEUCHI, ET AL.

It is certified that error appears in the above-identified patent and that said Letters Patent is hereby corrected as shown below:

ON THE COVER PAGE:

Item [76] Inventors:

"[76] Inventors: Tatsuo Takeuchi; Sono Gu, both of c/o Canon Kabushiki Kaisha 30-2, 3-chome, Shimomaruko, Ohta-ku; Yoshihiro Kuroyama; Teruhisa Shimada, both of c/o Nippon Paper Industries Co., Ltd. 1-30-6, Kamiochiai, Shinjuku-ku, all of Tokyo, Japan"

should read

--[75] Inventors: Tatsuo Takeuchi, Kawasaki; Sono Gu, Kawasaki; Yoshihiro Kuroyama, Tokyo; Teruhisa Shimada, Tokyo, all of Japan--.

Before Item [21] insert:

--[73] Assignees: Canon Kabushiki Kaisha, Tokyo; Nippon Paper Industries Co., Ltd., Tokyo, both of Japan--.

UNITED STATES PATENT AND TRADEMARK OFFICE

CERTIFICATE OF CORRECTION

PATENT NO. : 5,714,235

DATED : February 3, 1998

INVENTOR(S) : TATSUO TAKEUCHI, ET AL.

It is certified that error appears in the above-identified patent and that said Letters Patent is hereby corrected as shown below:

Before Item [57] insert:

--*Attorney, Agent, or Firm* – Fitzpatrick, Cella, Harper & Scinto--.

IN THE DISCLOSURE:

COLUMN 3:

Line 46, "SET" should read --BET--.

COLUMN 4:

Line 57, "250 G/m$^2$," should read --250 g/m$^2$,--.

COLUMN 11:

Table 2, "Degree of curling" should read --Degree of curling (cm)--.

Signed and Sealed this

Thirtieth Day of November, 1999

*Attest:*

*Attesting Officer*

Q. TODD DICKINSON

*Acting Commissioner of Patents and Trademarks*